US007335099B2

(12) United States Patent
Friedman

(10) Patent No.: US 7,335,099 B2
(45) Date of Patent: Feb. 26, 2008

(54) METHOD FOR PLAYING WAGERING GAMES

(75) Inventor: Stacy A Friedman, San Francisco, CA (US)

(73) Assignee: Olympian Gaming LLC, Beaverton, OR (US)

( * ) Notice: Subject to any disclaimer, the term of this patent is extended or adjusted under 35 U.S.C. 154(b) by 829 days.

(21) Appl. No.: 10/271,683

(22) Filed: Oct. 15, 2002

(65) Prior Publication Data

US 2003/0073475 A1 Apr. 17, 2003

Related U.S. Application Data

(60) Provisional application No. 60/329,613, filed on Oct. 15, 2001.

(51) Int. Cl.
*A63F 9/24* (2006.01)

(52) U.S. Cl. ..... 463/11; 273/292

(58) Field of Classification Search ..... 463/9–13; 273/264, 268, 271, 289, 293, 296, 303–305, 273/307, 292

See application file for complete search history.

(56) References Cited

U.S. PATENT DOCUMENTS 1,549,095 A * 8/1925 Levine ..... 273/293
4,170,358 A * 10/1979 Hancock ..... 273/304
5,248,142 A * 9/1993 Breeding ..... 273/138.1
5,280,916 A * 1/1994 Gleason, Jr. ..... 273/304
5,697,616 A * 12/1997 Wilyard ..... 273/303
5,741,012 A * 4/1998 So et al. ..... 273/292
6,113,103 A * 9/2000 Mostashari ..... 273/292
6,149,155 A * 11/2000 Hoyt et al. ..... 273/292
6,312,332 B1 * 11/2001 Walker et al. ..... 463/23
6,375,190 B1 * 4/2002 Kocher ..... 273/303
6,474,646 B1 * 11/2002 Webb ..... 273/274
6,672,959 B2 * 1/2004 Moody et al. ..... 463/13
6,749,501 B2 * 6/2004 Crawford ..... 463/13
2001/0046890 A1 * 11/2001 Ferguson ..... 463/13

* cited by examiner

*Primary Examiner*—Scott Jones
*Assistant Examiner*—Dat Nguyen
(74) *Attorney, Agent, or Firm*—Muskin & Cusick LLC

(57) ABSTRACT

The embodiments of present invention provide a method for playing wagering games with dominoes. According to a first embodiment of the present invention, a player first places a wager and a dealer then deals three dominoes each to the player and the dealer. The player is then afforded the opportunity to inspect the three dominoes and to arrange their orientation to produce a top hand and a bottom hand defined by a separating line of each domino. The top hand rank is determined by spot values above the separating line and the bottom hand rank is determined by the spot values below the separating line. The dealer arranges their dominoes in the same fashion as the players. Once the arrangements are complete, the player's wager is resolved by evaluating the player's top and bottom hand to the dealer's top and bottom hand in a predetermined fashion.

29 Claims, 4 Drawing Sheets

METHOD FOR PLAYING WAGERING GAMES

CROSS REFERENCE TO RELATED APPLICATIONS

This application claims the benefit of U.S. Provisional Application No. 60/329,613, filed Oct. 15, 2001.

FIELD OF THE INVENTION

The embodiments of the present invention relate to a method of playing wagering games using standard dominoes. More specifically, wagering games in which the indicia on each domino are evaluated independently of each other.

BACKGROUND

Standard dominoes are well known in the history of gaming objects. Scarne's Encyclopedia of Games, 1st edition and published in 1973, describes dominoes as "a set comprised of 28 pieces called dominoes wherein each domino is divided by a line across its center separating the two ends. Its face looks like the two uppermost faces of a pair of dice, and each half bears the spots from one through six or is blank (without spots). The dominoes rank in value from the double six or 6-6 (12 points, high), to the double blank (0 points, low). All dominoes are valued at their sum total: 6-5 is 11 points, 4-3 is 7 points, etc."

Scarne lists many games played with dominoes. The popularity of games utilizes dominoes lies partly in the tactile and auditory sensations of manipulating the dominoes, which are substantial in mass and smooth to the touch. Moreover, dominoes provide a satisfying clicking sound similar to casino chips. The vast majority of domino games involve placing dominoes in a predetermined fashion on a playing surface and calculating a winning point total once certain criteria have been met. Traditionally, wagering on domino games involves either a cash value per point or a fixed wager per game.

A notable exception to the traditional wagering systems is the Chinese game of Pai Gow in which a Chinese set of 32 dominoes is used. In Chinese Pai Gow, each player receives four dominoes and splits them into a high hand and low hand of two dominoes each. Each player then compares a high hand with a dealer's high hand and a low hand with the dealer's low hand. Each player wins their wager if the player wins both comparisons and loses their wager if the dealer wins both comparisons. Comparisons are conducted using a predetermined ranking scheme which is partially, but not entirely, based on the sum of the spots on each domino.

A disadvantage of the current set of domino games for the casino is that they are not readily suited for casino play. A game of traditional dominoes can take many minutes, whereas successful casino games tend to allow several wagers per minute. Another disadvantage of Chinese Pai Gow is that the rules for ranking hands are not obvious and must be memorized. Such memorization makes it very difficult for a casual casino patron to approach the game and begin playing. Therefore, Chinese Pai Gow games attract only very experienced players.

SUMMARY

The embodiments of the present invention address the disadvantages of the previous domino casino wagering games. Accordingly, the embodiments of the present invention provide a wagering game that takes advantage of pleasing tactile and auditory sensations of playing with dominoes, provide a wagering game with a relatively short duration, thereby increasing the feasibility of casino play, provide a wagering game with simple rules, and provide a wagering game with a new strategy, more specifically, how to orient each domino to produce multiple hands by considering the two halves of each domino individually. Considering the two halves of each domino individually is contrary to Scarne's assertion that all dominoes are valued at their sum total.

According to first embodiment of the present invention, a player places a wager and a dealer deals three dominoes each to the player and to the dealer. The player is then afforded the opportunity to inspect the three dominoes and to arrange their orientation to produce a top hand and a bottom hand. In such an arrangement, points of a top hand are based the spot values on the dominoes above the separating line and points of a bottom hand are based on the spot values on the dominoes below the separating line. The dealer arranges her three dominoes similarly. Once the arrangements are complete, the player's wager is resolved by evaluating the player's two hands and the dealer's two hands in a predetermined fashion. In the first embodiment, a player's bottom hand must rank higher than the player's top hand. The opposite could also be mandated.

According to a second embodiment of the present invention, a player places a wager and a dealer deals four dominoes to the player. The player is then afforded the opportunity to inspect the four dominoes and to arrange them to produce a top scoring hand and a bottom qualifying hand. In such an arrangement, points of a top hand are based on the spot values on the dominoes above the separating line and points of a bottom hand are based on the spot values of the dominoes below the separating line. Once the arrangement is complete, the player's wager is resolved by evaluating the player's qualifying hand and scoring hand against a pay table in a predetermined fashion. Various modifications to the first and second embodiments are discussed herein.

These and various other features which characterize the invention are pointed out with particularity in the claims annexed hereto and which form a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION

Figure 1:
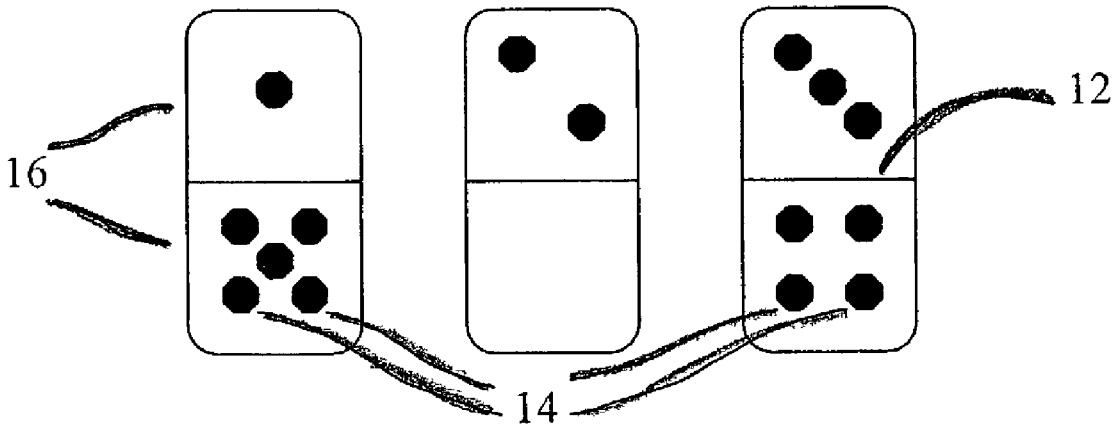
FIG. 1 is an illustration of several standard dominoes.
Figure 2:
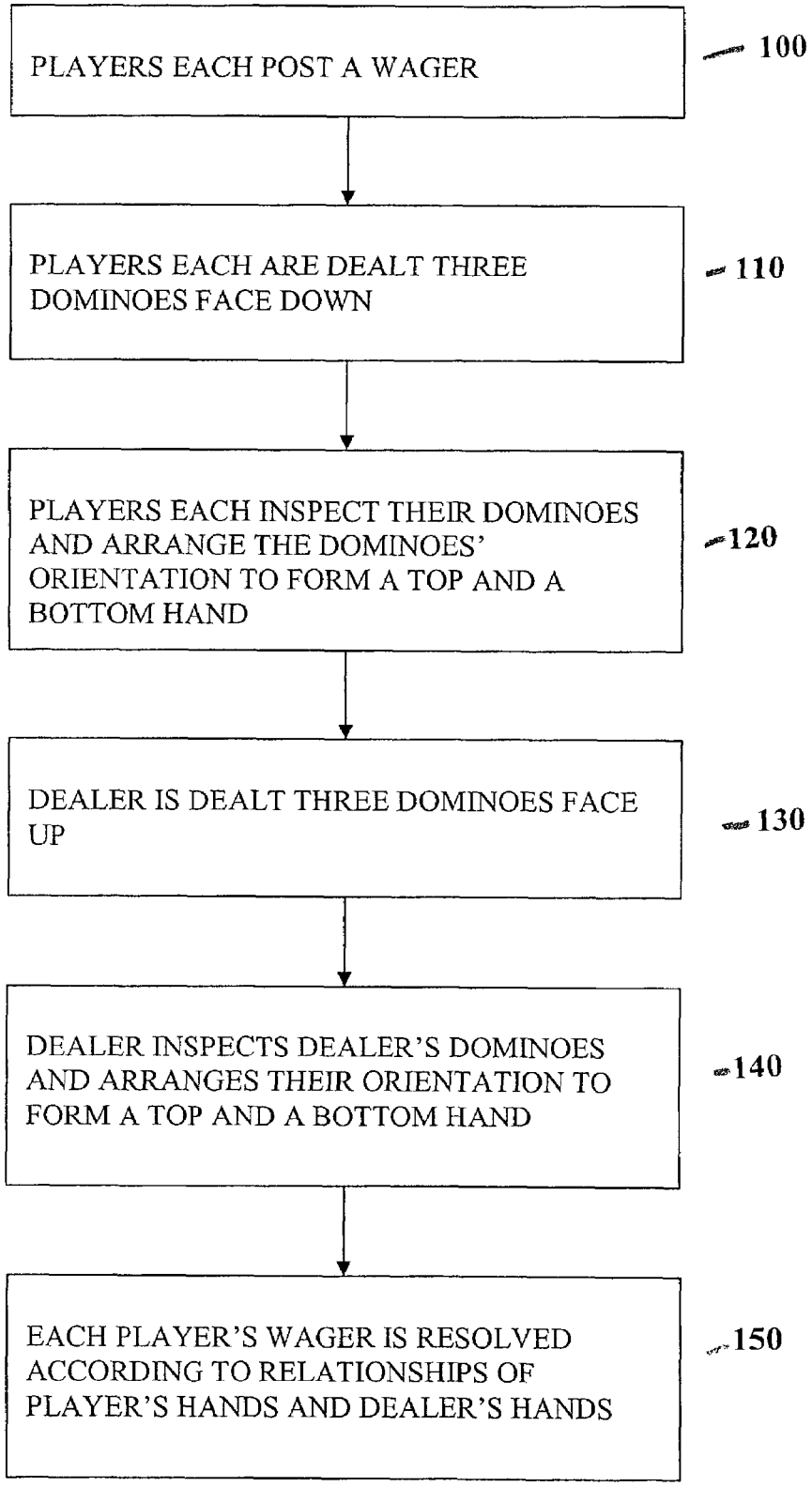
FIG. 2 is a flow chart illustrating the steps of playing a wagering game according to a first embodiment of the present invention.

FIG. 1 illustrates several conventional dominoes for playing the embodiments of the present invention. The dominoes include marking indicia 14 and two halves 16 defined by a separating line 12. Referring now to FIG. 2, a method of playing a wagering game according to a first embodiment of the present invention is described. In the first embodiment of the present invention, a single set of 28 standard dominoes is employed. Alternatively, a standard set plus additional dominoes or a non-standard set of dominoes may be employed. The game may be played by one or more players, in electronic video formats, on personal computer, over a global computer network, or in a live casino table game setting.

In a live casino table game setting, each of one or more players is first afforded an opportunity to place a wager 100 to participate in the game. Each player is then dealt three dominoes face-down 110. After inspecting their dominoes, each player arranges their dominoes into a top and bottom hand by rotating each domino such that each domino's spot values are arranged above and below each domino's separating line as desired 120. The top hand is then comprised of the spot values above each domino's separating line and the bottom hand is comprised of the spot values below each domino's separating line. In this first embodiment, the player's bottom hand must rank at least greater than, or equal to, the player's top hand. The dealer then deals himself three dominoes face-up 130 and also arranges them into a top and bottom hand 140. Finally, each player's dominoes are exposed and compared 150 against the dealers dominoes as follows:

a. If the player's top hand ranks higher than the dealer's top hand, and the player's bottom hand ranks higher than the dealer's bottom hand, the player wins the wager and is paid off at even odds;

b. If one of the player's hands ranks higher than the dealer's corresponding hand and the other player's hand ranks equal to the dealer's corresponding hand, the player wins the wager and is paid off at even odds;

3. If one of the player's hands ranks higher than the dealer's corresponding hand and the other player's hand ranks less than the dealer's corresponding hand, the player pushes the wager; and d. If neither of the player's hands rank higher than the dealer's corresponding hand, the player loses the wager.

The dealer's arrangement of his dominoes may be pursuant to a predetermined methodology, random or dealer choice.

In the first embodiment, the ranking scheme is based on the numerical sum of the spots in the hand. However, as set forth below, alternative ranking schemes may be employed.

Figure 3:
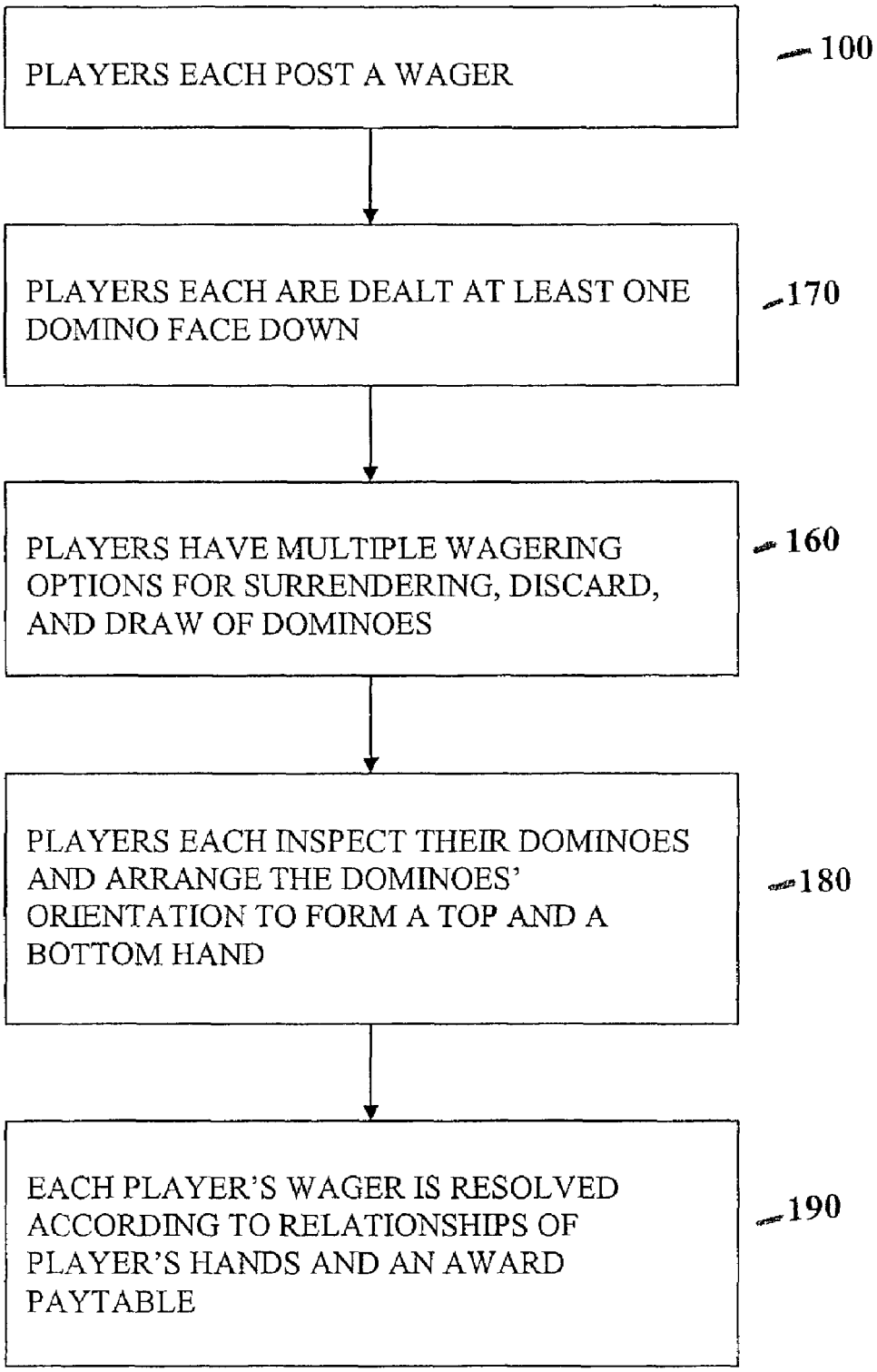
FIG. 3 is a flow chart illustrating the steps of playing a wagering game according to a second embodiment of the present invention.

Referring now to FIG. 3, a method of playing a wagering game according to a second embodiment of the present invention is described. In the second embodiment of the present invention, a single set of 28 standard dominoes is employed. Alternatively, a standard set plus additional dominoes or a non-standard set may be used. The game may be played by one or more players, in electronic video formats, on personal computer, over a global computer network, or in a live casino table game setting.

In the second embodiment, each of the one or more players is first afforded an opportunity to place a wager 100 to participate in the game. Each player is then dealt four dominoes face-down 170. After inspecting their dominoes, each player arranges their dominoes into a top scoring hand and a bottom qualifying hand by rotating each domino such that the spot values above and below each domino's separating line are as desired 180. The top hand is then comprised of the spot values above the separating line and the bottom hand is comprised of the spot values below the separating line. Once the players' arrangements are complete, each player's hand is revealed and evaluated 190 against a pay table as follows:

1. If the player's qualifying hand meets or exceeds a predetermined minimum rank, or no predetermined minimum rank is utilized, the player's scoring hand is evaluated against a predetermined pay table and the player is paid accordingly. The pay table may include positive awards, negative awards and a zero award indicating that the player wins, loses or pushes respectively.

2. If the player's qualifying hand does not meet a predetermined minimum rank, the player loses the wager.

In the first embodiment, the ranking scheme is based on the numerical sum of the spots in the hand. However, as set forth below, alternative ranking schemes may be employed.

Additional embodiments of the present invention are set forth below. The various alternative options discussed below may be employed alone or in any combination or permutation.

While the first and second embodiments detail the use of three and four dominoes, respectively, it is understood that the number of dominoes employed may fluctuate without departing from the spirit and scope of the present invention.

As suggested above, various alternative ranking schemes may be employed. For example, a poker-style ranking scheme, wherein hands are ranked according to the number of matching indices, or to consecutive sequences may be employed. In such a ranking system, ranked hands may include a pair, two pair, three-of-a-kind, straight, full house and four-of a-kind. The order of the rankings may be modified accordingly. A second example provides a baccarat-style ranking scheme, wherein hands are ranked according to their numerical sum modulo ten. Thus, for example, a sum of fourteen would score as four and a sum of twenty-two would score as two.

In another embodiment as shown in FIG. 2, players may be afforded the option 160, or may be required, to modify their initial wagers before the game continues. The wagering aspects may be modified by permitting, or requiring, players to increase their wager prior to continuing the game, allowing players to remove part of the wager and surrender a remainder of the wager, allowing players to increase their wagers to subsequently receive additional dominoes, allowing players to increase their wagers to purchase additional dominoes and allowing players to increase their wagers to replace existing dominoes.

It should be understood that the embodiments of the domino wagering game disclosed herein are also ideal for implementation in an electronic gaming machine. It is well known to utilize gaming machines, controlled by processing units, for operating wagering games. The processing unit is typically a computer microprocessor. The first and second embodiments of the present invention will be used to describe a gaming machine implemented version of the present invention.

Figure 4:
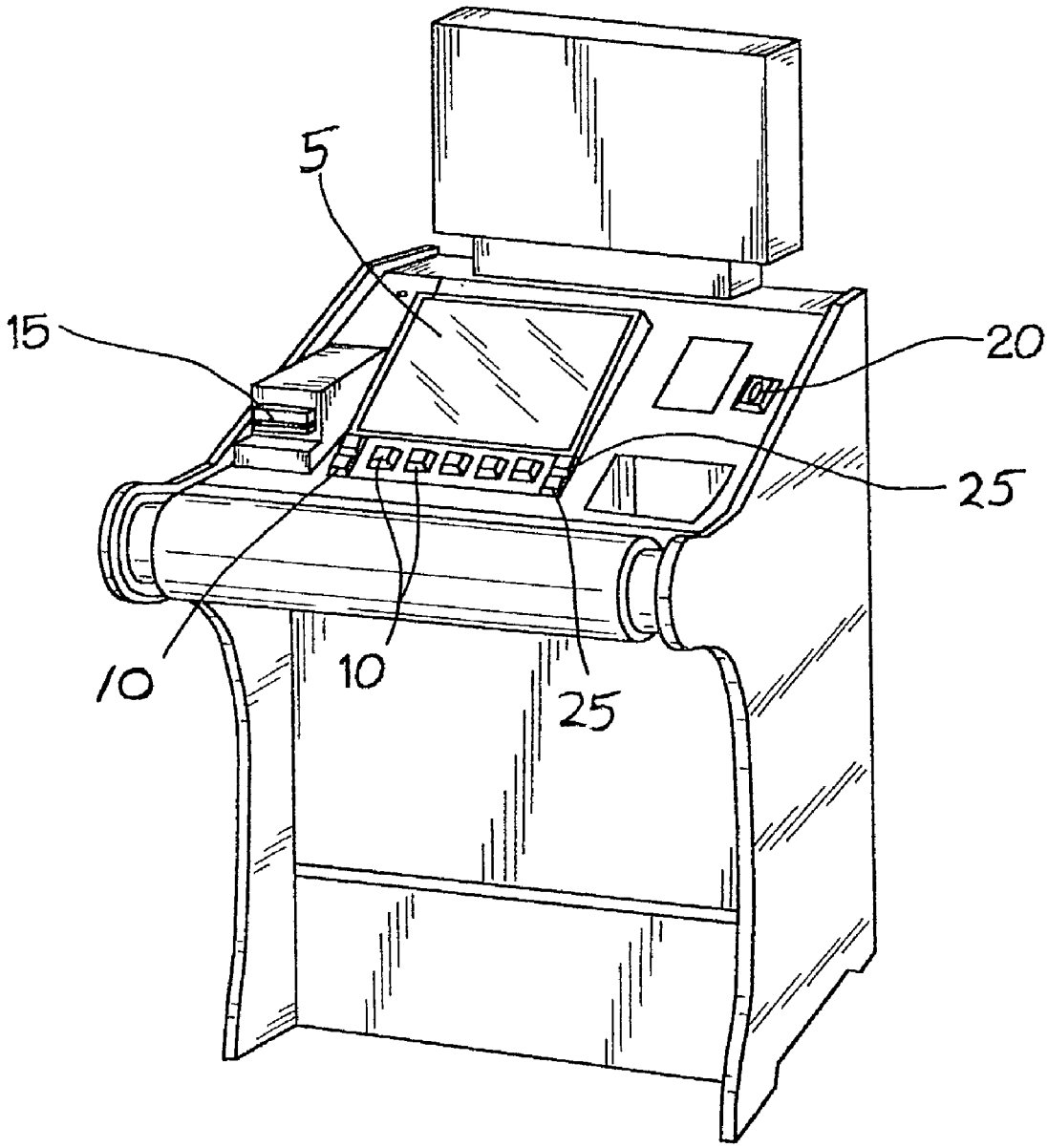
FIG. 4 is a gaming machine of the type that may be used to implement an electronic version of the embodiments of the present invention.

As shown in FIG. 4, the gaming machine incorporates a wager accepting means such that a player may place one or more wagers. Once a wager is accepted, a gaming machine processor causes three randomly selected dominoes to be dealt and displayed to the player and the dealer. The dominoes are displayed on a gaming machine display unit such as a CRT screen, plasma screen, video screen, etc. The gaming machine includes means for the player to arrange his three dominoes into a top and bottom hand. The arrangement means may be in the form of a touch screen or panel buttons. The processing unit arranges the dealer's dominoes in a preprogrammed fashion or in a random fashion. Thereafter, the processing unit causes the player's top and bottom hands to be compared to the dealer's top and bottom hands to determine whether a payout is due. If so, the player is paid in credits or coins. Each of the embodiments of the present invention can be practiced by means of an electronic gaming machine or in a live setting at a wagering table. A similar procedure is followed for playing the embodiments of the present invention on a personal computer or over a global computer network. However, means for being awarded payouts may take the form of a credit being applied to a player's credit card credit or winnings being mailed to a player. Moreover, a computer mouse or keyboard strokes may provide means for arranging gaming dominoes.

The second embodiment is particularly well-suited for implementation with a gaming machine, on a personal computer or over a computer network. The second embodiment only requires the player to arrange his dominoes such that they are then compared by the processor unit to payouts listed in a stored pay table. Unlike the first embodiment, there is no need to preprogram the processor to arrange the dealer's dominoes or randomly arrange the dealer's dominoes. Therefore, the game is played in a substantially identical fashion to conventional video poker (i.e. player's hands being compared to a stored pay table).

It is to be understood, however, that even though numerous characteristics of the present invention have been set forth in the foregoing description, together with an explanation of various possible embodiments and modifications thereto, this disclosure is illustrative only and changes may be made within the spirit of the invention to the full extent indicated by the broad general meaning of the terms in which the appended claims are expressed.

I claim:

1. A method of playing a wagering game comprising:

accepting a first wager from a player;

dealing at least two player playing elements to player, the player playing elements each comprising two numerical values;

dealing at least two dealer playing elements to a dealer the dealer playing elements each comprising two numerical values;

rotating, by the player, said at least two player playing elements into a first player hand and a second player hand so that the player can choose which of the two numerical values on each respective playing element will be included in the first player had and which of the two numerical values on each respective playing element will be included in the second player hand, wherein both numerical values on each playing element cannot be assigned to a same hand;

rotating, by the dealer, said at least two dealer playing elements into a first dealer hand and a second dealer hand so that the dealer can choose which of the two numerical values on each respective playing element will be included in the first dealer hand and which of the two numerical values on each respective playing element will be included in the second dealer hand, wherein both numerical values on each playing element cannot be assigned to a same hand;

determining a first player hand evaluation of the first player hand and a second player hand evaluation of the second player hand and a first dealer hand evaluation of the first dealer hand and a second dealer hand evaluation of the second dealer hand;

comparing the first player hand evaluation to the first dealer hand evaluation;

comparing the second player hand evaluation to the second dealer hand evaluation; and determining a payout based on the first wager using both comparing operations.

2. The method of claim 1 wherein the player is awarded the payout when the first player hand evaluation is less than the first dealer hand evaluation.

3. The method of claim 2 wherein said payout is further dependent upon whether the second player hand evaluation not is less than the second dealer hand evaluation.

4. The method of claim 2 wherein said payout is further dependent upon whether the second player hand evaluation is not less than the first player hand evaluation.

5. The method of claim 3 wherein said payout is further dependent upon whether the player hand evaluation is not less than the first player hand evaluation.

6. The method of claim 1 wherein the player is awarded the payout when either the first player hand evaluation or second player hand evaluation is stronger than the first dealer hand evaluation or the second dealer hand evaluation, respectively and the player's other separate hand evaluation is equal to the dealer's corresponding other separate hand evaluation.

7. The method of claim 6 wherein said payout is further dependent upon whether the second player hand evaluation is not less than the first player hand evaluation.

8. The method of claim 1 further including an operation wherein the player is afforded an option if increasing the first wager once the player has received some playing elements.

9. The method of claim 1 further including an operation wherein each player is afforded an option of decreasing the first wager once the player has received some playing elements.

10. The method of claim 1 further including an operation wherein each player is afforded an option of surrendering at least a portion of the first wager once the player has received some playing elements.

11. The method of claim 1 further including an operation wherein the player is afforded an option of increasing the first wager for additional playing elements.

12. The method of claim 1 further including an operation wherein the player is afforded an option to replace one or more dealt playing elements.

13. The method as recited in claim 1, wherein the first player hand evaluation is a poker rank of the first player hand, the second player hand evaluation is a poker rank of the second player hand, the first dealer hand evaluation is a poker rank of the first dealer hand, and the second dealer hand evaluation is a poker rank of the second dealer hand.

14. The method as recited in claim 13, wherein the determining determines that the payout is positive when the poker rank of the first player hand is not less than the poker rank of the first dealer hand and the poker rank of the second player hand is not less than the poker rank of the second dealer hand.

15. The method as recited in claim 1, wherein the first player hand evaluation is a numerical valuation of the first player hand, the second player hand evaluation is a numerical valuation of the second player hand, the first dealer hand evaluation is a numerical valuation of the first dealer hand, and the second dealer hand evaluation is a numerical valuation of the second dealer hand.

16. The method as recited in claim 15, wherein the determining determines that the payout is positive when the numerical valuation of the first player hand is not less than the numerical valuation of the first dealer hand and the numerical valuation of the second player hand is not less than the numerical valuation of the second dealer hand.

17. The method as recited in claim 1, wherein the first player hand evaluation is a summation of the numerical values in the first player hand, the second player hand evaluation is a summation of the numerical values in the second player hand, the first dealer hand evaluation is a summation of the numerical values in the first dealer hand, and the second dealer hand evaluation is a summation of the numerical values in the second dealer hand.

18. The method as recited in claim 17, wherein the determining determines that the payout is positive when the summation of the numerical values in the first player hand is not less than the summation of the numerical values in the first dealer hand and the summation of the numerical values in the second player hand is not less than the summation of the numerical values in the second dealer hand.

19. The method as recited in claim 1, wherein the first player hand evaluation is a summation of the numerical values in the first player hand modulo a divisor, the second player hand is a summation of the numerical values in the second player hand modulo the divisor, the first dealer hand evaluation is a summation of the numerical values in the first dealer hand modulo the divisor, and the second dealer hand evaluation is a summation of the numerical values in the second dealer hand modulo the divisor.

20. The method as recited in claim 19, wherein the determining determines that the payout is positive when the first player hand evaluation is not less than the first dealer hand evaluation and the second player hand evaluation is not less than the second dealer hand evaluation.

21. The method as recited in claim 1, wherein the rotating by the dealer is performed according to a predetermined methodology.

22. A method of playing a wagering game comprising:

accepting a first wager from a player;

dealing at least two player dominoes to the player, the player dominoes each comprising two numerical values;

dealing at least two dealer dominoes to a dealer the dealer dominoes each comprising two numerical values;

rotating, by the player, said at least two player dominoes into a first player hand and a second player hand so that the player can choose which of the two numerical values on each respective domino will be included in the first player hand and which of the two numerical values on each respective domino will be included in the second player hand, wherein both numerical values on each domino cannot be assigned to a same hand;

rotating, by the dealer, said at least two dealer dominoes into a first dealer hand and a second dealer hand so that the dealer can choose which of the two numerical values on each respective domino will be included in the first dealer hand and which of the two numerical values on each respective domino will be included in the second dealer hand, wherein both numerical values on each domino cannot be assigned to a same hand;

determining a first player hand evaluation of the first player hand and a second player hand evaluation of the second player hand and a first dealer hand evaluation of the first dealer hand and a second dealer hand evaluation of the second dealer hand;

comparing the first player hand evaluation to the first dealer hand evaluation;

comparing the second player hand evaluation to the second dealer hand evaluation; and determining a payout based on the first wager using both comparing operations.

23. A method of playing a wagering game comprising:

accepting a first wager from a player;

dealing at least two player playing elements to the player, the player playing elements each comprising two numerical values;

rotating, by the player, said at least two player playing elements into a first player hand and a second player hand so that the player can choose which of the two numerical values on each respective playing element will be included in the first player hand and which of the two numerical values on each respective playing element will be included in the second player hand, wherein both numerical values on each playing element cannot be assigned to a same hand;

determining if an evaluation of the first player hand meets a predetermined minimum evaluation, and if not, then the player loses the first wager, and if so, then determining a payout based on an evaluation of the second player hand.

24. The method as recited in claim 23, wherein the evaluation of the first player hand is a poker rank of the first player hand and the evaluation of the second player hand is a poker rank of the second player hand.

25. The method as recited in claim 23, wherein the evaluation of the first player hand is a numerical valuation of the first player hand and the evaluation of the second player hand is a numerical valuation of the second player hand.

26. The method as recited in claim 23, wherein the evaluation of the first player hand is a summation modulo a divisor of numerical values of all playing elements in the first player hand and the evaluation of the second player hand is a summation modulo a divisor of numerical values of all playing elements in the second player hand.

27. The method as recited in claim 23, wherein the evaluation of the first player hand is a summation of numerical values of all playing elements in the first player hand and the evaluation of the second player hand is a summation of numerical values of all playing elements in the second player hand.

28. An apparatus to play a wagering game using playing elements wherein each playing element comprises two numerical values, the apparatus comprising:

a processing unit performing:

accepting a first wager from a player;

dealing at least two player playing elements to the player, the player playing elements each comprising two numerical values;

dealing at least two dealer playing elements to a dealer the dealer playing elements each comprising two numerical values;

rotating, by the player, said at least two player playing elements into a first player hand and a second player hand so that the player can choose which of the two numerical values on each respective playing element will be included in the first player hand and which of the two numerical values on each respective playing element will be included in the second player hand, wherein both numerical values on each playing element cannot be assigned to a same hand;

rotating, by the dealer, said at least two dealer playing elements into a first dealer hand and a second dealer hand so that the dealer can choose which of the two numerical values on each respective playing element will be included in the first dealer hand and which of the two numerical values on each respective playing element will be included in the second dealer hand, wherein both numerical values on each playing element cannot be assigned to a same hand;

determining a first player hand evaluation of the first player hand and a second player hand evaluation of the second player hand and a first dealer hand evaluation of the first dealer hand and a second dealer hand evaluation of the second dealer hand;

comparing the first player hand evaluation to the first dealer hand evaluation;

comparing the second player hand evaluation to the second dealer hand evaluation; and determining a payout based on the first wager using both comparing operations; and an output device outputting results of the processing unit.

29. An apparatus to play a wagering game using playing elements wherein each playing element comprises two numerical values, the apparatus comprising:

a processing unit performing:

accepting a first wager from a player;

dealing at least two player playing elements to the player, the player playing elements each comprising two numerical values;

rotating, by the player, said at least two player playing elements into a first player hand and a second player hand so that the player can choose which of the two numerical values on each respective playing element will be included in the first player hand and which of the two numerical values on each respective playing element will be included in the second player hand, wherein both numerical values on each playing element cannot be assigned to a same hand;

determining if an evaluation of the first player hand meets a predetermined minimum evaluation, and if not, then the player loses the first wager, and if so, then determining a payout based on an evaluation of the second player hand, an output device outputting results of the processing unit.

* * * * *